United States Patent [19]

Satou

[11] Patent Number: 4,849,745

[45] Date of Patent: Jul. 18, 1989

[54] MULTIPLE MEMORY IMAGE DISPLAY APPARATUS

[75] Inventor: Hitoshi Satou, Utsunomiya, Japan

[73] Assignee: Kabushiki Kaisha Toshiba, Kawasaki, Japan

[21] Appl. No.: 144,728

[22] Filed: Jan. 14, 1988

Related U.S. Application Data

[63] Continuation of Ser. No. 743,702, Jun. 11, 1985, abandoned.

[30] Foreign Application Priority Data

Jun. 15, 1984 [JP] Japan ..... 59-124306

[51] Int. Cl.[4] ..... G09G 1/14

[52] U.S. Cl. ..... 340/723; 340/721; 340/725; 340/799

[58] Field of Search ..... 340/721, 723, 724, 725, 340/744, 798, 799; 364/413, 414, 415, 518, 521

[56] References Cited

U.S. PATENT DOCUMENTS

| | | | |
|---|---|---|---|
| 3,678,497 | 7/1972 | Watson et al. . | |
| 4,069,511 | 1/1978 | Lelke . | |
| 4,205,389 | 5/1980 | Heartz . | |
| 4,243,984 | 1/1981 | Ackley et al. . | |
| 4,256,573 | 5/1981 | Chaikin et al. . | |
| 4,356,482 | 10/1982 | Oguchi . | |
| 4,489,389 | 12/1984 | Beckwith et al. . | |
| 4,622,545 | 11/1986 | Atkinson | 340/734 |
| 4,642,621 | 2/1987 | Nemoto et al. | 340/723 |
| 4,642,790 | 2/1987 | Mirshull et al. | 340/734 |

*Primary Examiner*—John W. Caldwell, Sr.
*Assistant Examiner*—Jeffery A. Brier
*Attorney, Agent, or Firm*—Finnegan, Henderson, Farabow, Garrett, Dunner

[57] ABSTRACT

In an image display apparatus, a frame memory for storing original data and a display memory for storing display data are used as memories for storing image data. The image data is read out from the display memory and is displayed by a display system. When image data transfer from the frame memory to the display memory is performed through a programmable data conversion memory, data conversion is performed as image processing. The image display apparatus has a masking memory having an image area corresponding to the frame memory. The masking memory stores image data indicating a desired transfer area in the frame memory as a mask pattern in advance. The image data transfer from the frame memory to the display memory is performed only for an area designated by the masking memory.

9 Claims, No Drawings

MULTIPLE MEMORY IMAGE DISPLAY APPARATUS

This application is a continuation of application Ser. No. 743,702, filed June 11, 1985, now abandoned.

BACKGROUND OF THE INVENTION

The present invention relates to an image display apparatus used in a tomographic apparatus such as an X-ray CT (computed tomographic) apparatus or a magnetic resonance imaging system (MRI system).

In an imaging system of, e.g., an X-ray CT apparatus or an MRI system, an image display apparatus is used for displaying an image.

In the image display apparatus of this type, cine display (motion display) for displaying motion of a stomach or a heart as motion pictures is performed.

The cine display of an image in, for example, a $512^2$ ($512\times512$) matrix corresponds to sequential display of 20 to 30 still images per second. For the cine display in a conventional image display system, if a series of images (still images sequentially displayed to display each image for a predetermined period of time) to be recognized as substantially a one-frame still image is given to an image unit, image information corresponding to 20 to 30 still images of the $512^2$ matrix per image unit is stored in a memory, and the 20 to 30 still images, data of which are stored in the memory, are switched at high speed and displayed. Therefore, in order to perform cine display, a very large capacity memory must be used, and the image stored in the memory must be switched at high speed and displayed. For this reason, it is very difficult to realize an image display apparatus.

Furthermore, when window processing is performed for the image information (gradation is provided in a specific gray level range of the original image data), a larger capacity memory than that described above is required, and the memory switching access becomes more complicated. Image write/read access with respect to the memory and window processing are performed by a common central processing unit (CPU). Therefore, an image display switching speed is considerably decreased. For this reason, it is still more difficult to realize the image display apparatus.

SUMMARY OF THE INVENTION

It is an object of the present invention to provide an image display apparatus which can easily perform effective high-speed switching display and cine display of a plurality of images.

In the image display apparatus according to the present invention, a frame memory for storing original data prior to image data processing and a display memory for storing display image data are used as memories for storing image data. The image data is read out from the display memory and is displayed by a display system. Data transfer from the frame memory to the display memory is performed in accordance with a DMA (direct memory access) scheme. In this apparatus, the data transfer is also performed through a data conversion memory which is programmable, thus performing data conversion as image processing. In addition, the apparatus comprises a masking memory having an image area corresponding to the frame memory. The masking memory stores image data indicating a desired transfer area in the frame memory as a mask pattern in advance. When the data is transferred in accordance with the DMA scheme, a desired part of the image data stored in the frame memory, i.e., a portion corresponding to a transfer area set in the masking memory, is transferred from the frame memory to the display memory through the data conversion memory in response to an address signal generated in synchronism with a sync signal used when the image data is read out from the display memory and is displayed by the display system. Therefore, in the apparatus, DMA transfer of the image data from the frame memory to the display memory is performed such that at least a part of the image data in the frame memory designated by the masking memory is transferred in synchronism with read scanning of the image data from the display memory.

According to the image display apparatus of the present invention, at least a part of the image data stored in the frame memory, i.e., a desired portion corresponding to the transfer area set in the masking memory, is partially transferred while being image-processed in synchronism with the sync signal of the display system such that read display of an updating area due to transfer from the frame memory in the display system corresponds to the transfer. Therefore, the desired portion of the image data stored in the frame memory is set in the masking memory in the form of a mask pattern image in advance, and the desired portion can be partially transferred to the display memory. Thus, a plurality of images can be switched at high speed and displayed on the display system.

In addition, when the transfer area set in the masking memory is set to include a moving portion in cine display, and effective cine display can be performed.

Therefore, the present invention provides an image display apparatus in which a plurality of images can be switched at high speed and an effective cine display can be easily performed.

DETAILED DESCRIPTION OF THE PREFERRED EMBODIMENTS

Figure 1:
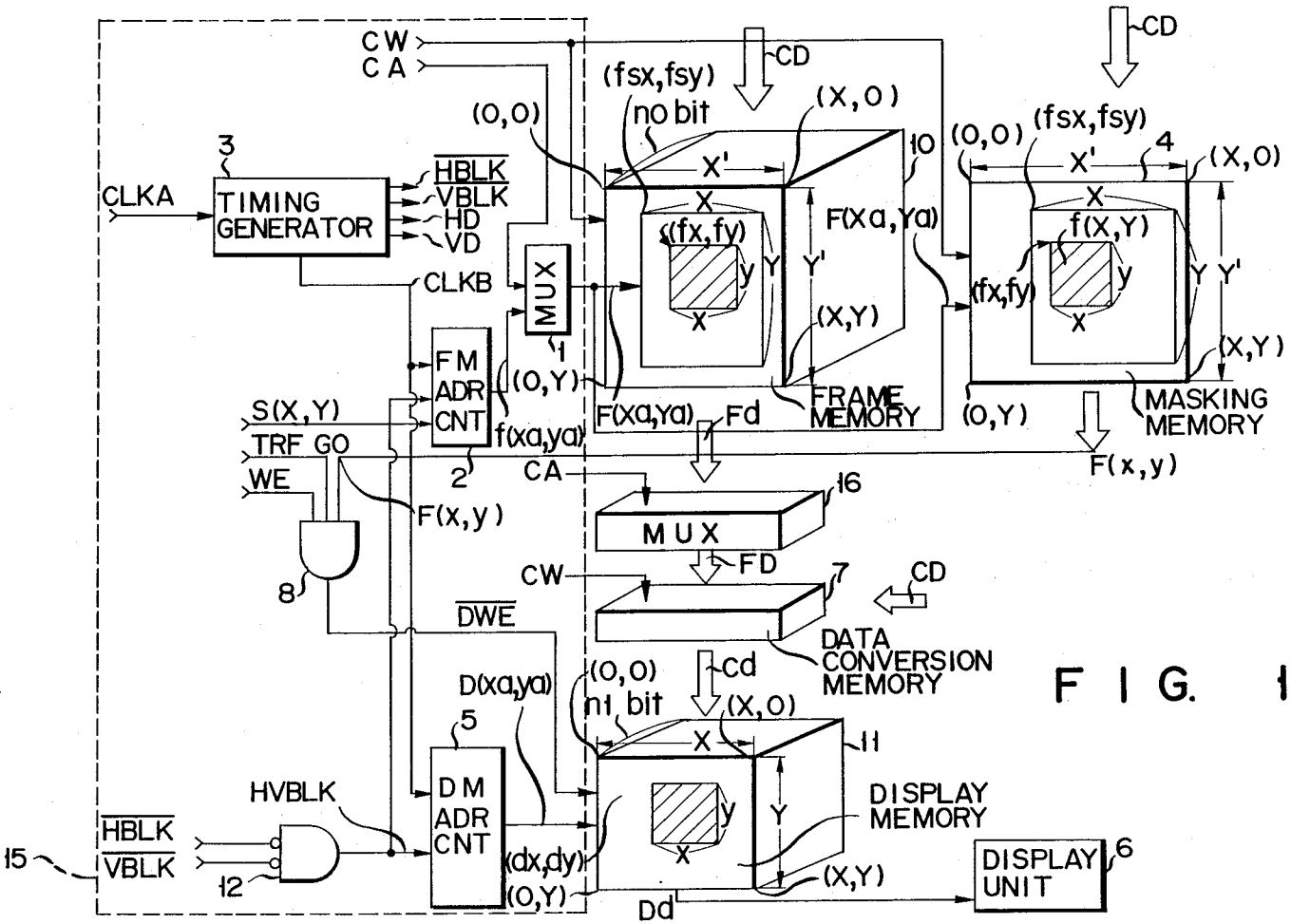
FIG. 1 is a block diagram showing a schematic arrangement of an image display apparatus according to a first embodiment of the present invention.

FIG. 1 shows an image display apparatus according to a first embodiment of the present invention.

Referring to FIG. 1, a frame memory 10 stores original image data. The original image data is transferred from, e.g., an external storage unit as image data CD under the control of a CPU (central processing unit: not shown), and the data CD is written in the frame memory 10 as first image data in response to a write signal supplied from the CPU. Output data (the first image data) Fd read out from the frame memory 10 is supplied to a data conversion memory 7 through a multiplexer (MUX) 16. In this case, the memory 7 has a capacity of $2 \times n1$ bits, and stores a table for converting the n0-bit data (the first image data) Fd read out from the frame memory 10 into n1-bit data Cd providing second image data. The memory 7 can be accessed by the CPU. Since various types of conversion tables are selectively written in the memory 7 under the control of the CPU, various types of tables can be used for converting the data (the first image data) Fd into the n1-bit data Cd (the second image data). For example, the memory may store second image data at an address corresponding to a value of first image data inputted thereto. The output data Cd from the data conversion memory 7 is located at the same x and y addresses as those of data stored in the frame memory 10. The output data from the memory 7 is supplied to a display memory 11. The display memory 11 has a matrix size $X \times Y$. A matrix size $X' \times Y'$ of the frame memory 10 is larger than that of the display memory 11. An output Dd from the display memory 11 is supplied to a display unit 6 and is displayed. The display unit 6 has a D/A (digital-analog) converter for converting the output Dd comprising digital data into analog data and a CRT (cathode-ray tube) display device. An image corresponding to a storage content of the display memory 11 is displayed on a screen of the display device.

A memory controller 15 for controlling the frame memory 10 and the display memory 11 is arranged in association with a masking memory 4 as follows.

In response to a reference clock signal CLKA supplied from a clock generator (not shown), a timing generator 3 generates a horizontal sync signal HD, a vertical sync signal VD, a horizontal blanking signal $\overline{\text{HBLK}}$, a vertical blanking signal $\overline{\text{VBLK}}$ and a signal CLKB which are used for image display at the display unit 6. Although not shown, the signals HD, VD, $\overline{\text{HBLK}}$ and $\overline{\text{VBLK}}$ are supplied to the display unit 6. The signal CLKB is supplied to a frame memory address counter (FM ADR CNT) 2 connected to the generator 3 and a display memory address counter (DM ADR CNT) 5 corresponding to the display memory 11 as a count pulse. The masking memory 4 is allocated in the same address space as that of the frame memory 10, and has a capacity of 1 bit per pixel. The masking memory 4 stores mask pattern data f(x,y). The mask pattern data f(x,y) sets an image transfer area (transfer image read area) in the frame memory 10. The data f(x,y) is transferred from the CPU as image data CD and is written in the masking memory 4 in response to the write signal CW from the CPU under the control of the CPU in accordance with a setting operation of an operator. The masking memory 4 is accessed parallel to scanning of pixels in the frame memory 10, and generates a mask pattern signal F(x,y) consisting of masking data corresponding to each pixel. The signal F(x,y) is supplied to a 3-input AND gate 8.

The counter 2 comprises a programmable sync counter (i.e., an SN 74163 available from Texas Instruments Inc.) and generates a signal f(xa,ya) in response to the signal CLKB generated from the generator 3, a count enable signal HVBLK generated from a NAND gate 12 (to be described later) and an externally supplied start address signal S(x,y) of the frame memory 10, e.g., through the CPU. The signal f(xa,ya) is supplied to one input terminal of a multiplexer (MUX) 1 connected to the counter 2. The multiplexer 1 receives the output signal f(xa,ya) from the counter 2 and an address signal CA on a CPU address bus. The multiplexer 1 selects one of these signals, and supplies an address input F(xa,ya) to the frame memory 10.

The AND gate 8 receives the mask pattern signal F(x,y) from the masking memory 4, and a partial transfer start signal TRFGO and a write signal WE, which are externally supplied. When the AND conditions of these signals are established, the AND gate 8 supplies a write signal $\overline{\text{DWE}}$ to the display memory 11. A write operation of the display memory 11 is controlled by the write signal $\overline{\text{DWE}}$.

The AND gate 12 having two negative inputs and a positive output receives the signals $\overline{\text{HBLK}}$ and $\overline{\text{VBLK}}$ supplied from the generator 3. The output from the NAND gate 12 is supplied to the counters 5 and 2 as the count enable signal HVBLK. The counter 5 receives the signal HVBLK from the AND gate 12 and the signal CLKB from the generator 3. The counter 5 generates an address signal D(xa,ya), which is supplied to the display memory 11.

The operation of the image display apparatus with the above arrangement will be described hereinafter.

First, image data write control for the frame memory 10 will be described.

When image data is written in the frame memory 10, the multiplexer 1 is enabled in response to the address signal CA transferred from the CPU address bus. The address signal CA is supplied to the frame memory 10 through the multiplexer 1. The frame memory 10 stores the image data CD transferred from the CPU in response to the address signal CA and the write signal CW supplied together with the data CD.

The mask pattern data f(x,y) stored in the masking memory 4 is coordinate address data indicating a partial transfer area pattern (i.e. read area) in the image data stored in the frame memory 10. The transfer area on the frame memory 10 is determined by this coordinate address data. The data f(x,y) is written in the masking memory 4 in accordance with the address signal CA (in this case, the address signal CA is selected by the multiplexer 1) and the write signal CW which are supplied from the CPU. A write operation of the data f(x,y), i.e., a setting operation of the mask pattern, is performed by interactive pre-editing such that an operator moves, e.g., a tracking ball, a joy stick, a mouse or the like to mouse, or the like shift a marker on a display screen so as to specify coordinates of a desired point.

The address signal F(xa,ya) of the frame memory 10 will be described.

The address signal F(xa,ya) to the frame memory 10 is selected and enabled by the multiplexer 1. When the output f(xa,ya) from the counter 2 is selected by the multiplexer 1, the output f(xa,ya) serves as the address signal F(xa,ya). In other words, the output HVBLK of the AND gate 12 is used as a load instruction and count enable signal of the counter 2. The start address signal S(x,y) supplied from the CPU is used as a load input signal (i.e. a preset value signal) of the counter 2. The signal CLKB generated from the generator 3 is used as a count pulse. Under these assumptions, the content of the memory 10 is read out in accordance with the address signal comprising the data f(xa,ya) generated from the counter 2. The load input signal S(x,y) is loaded in the counter 2 during a blanking period between each two adjacent display frames in synchronism with the signal VD of the display unit 6. In this manner, the n0-bit image data Fd read out from the memory 10 is converted into data FD by the multiplexer 16 and the data FD is converted into the image data Cd by the data conversion memory 7. The image data Cd is supplied to the display memory 11.

Note that the memory 7 stores various types of tables transferred from the CPU as the conversion tables. The conversion tables are written in the memory 7 in synchronism with the address data CA enabled by the multiplexer 16. In this case, the data CD transferred from the CPU is written in the memory 7 in accordance with the address data CA supplied from the CPU through the multiplexer 16 and the write signal CW from the CPU, thus forming the data conversion table.

Data is written in the display memory 11 when the output $\overline{DWE}$ of the AND gate 8 is enabled. The write address of the display memory 11 is designated by the counter 5. The counter 5 is responsive to the count enable signal HVBLK generated from the AND gate 12. The counter counts the signal CLKB generated from the generator 3 in the count enable mode. A count output D(xa,ya) from the counter 5 is supplied to the display memory 11 as the read address (when the output from the AND gate 8 is enabled, i.e., at "H" (high level), the read address also serves as the write address). The output D(xa,ya) from the counter 5 starts at, e.g., (0,0), and is changed in an order of (1,0), (2,0), . . . , (X,0), (0,1), (1,1), (2,1), (3,1), . . . , (0,Y), (1,Y), (2,Y), . . . , (X,Y), (0,0), (1,0) . . . The output D(xa,ya) is synchronized with the horizontal and vertical sync signals HD and VD of the display unit 6. The data stored in the display memory 11 is displayed by the display unit 6. The display unit 6 converts the digital data read out from the display memory 11 to analog data in accordance with the output D(xa,ya) of the counter 5, and displays it on the display device. The read address from the display memory 11 is designated by the counter 5, as described above.

In this manner, when the frame memory 10 and the display memory 11 are controlled by the memory controller 15, a specified portion of the image data in the frame memory 10 can be transferred to the display memory 11 and is displayed by the display unit 6.

Partial transfer for the image display apparatus will be described in more detail.

When only a part of the image data (indicated by the hatched portion in FIG. 1) in the display screen of the display memory 11 is updated, that is, when only a part of the image data (indicated by the hatched portion in FIG. 1) in the frame memory 10 is transferred to the display memory 11, a pattern corresponding to the above portion is set in the masking memory 4 by, e.g., operation of an operator. In other words, in the masking memory 4, "1" is written in the corresponding area f(X,Y), i.e., the hatched area in FIG. 1 through the CPU, and "0" is written in the other area. The storage content of the memry 4 is read out in synchronism with the signals HD and VD, and the readout data is supplied to the AND gate 8 as the mask pattern signal F(x,y) indicating the partial transfer area. When the signal CLKB is supplied to the counter 5, the count thereof as the read address of the display memory 11 is sequentially incremented. When the count reaches the address (dx,dy) corresponding to the address (fx,fy) of the frame memory 10, the signal F(x,y) read out from the memory 4 goes to "H". This is because the counter 2 also increments its count from a start address (fsx,fsy) set by the start address input S(x,y) by counting the signal CLKB in the same manner as in the counter 5, and the memories 10 and 4 are accessed in accordance with the count of the counter 2 in synchronism with access of the memory 11. In this case, if the signal TRFGO for the partial transfer mode supplied from the CPU goes to "H", the AND gate 8 is enabled, and the signal $\overline{DWE}$ goes to "H", i.e., enabled. When the signal $\overline{DWE}$ is enabled, the memory 11 is set in the write mode, and the image data read out from the frame 10 is written in the memory 11.

As previously described, the counter 2 is enabled when the start address input S(x,y) for the memory 10 is loaded as the address (fsx,fsy) and preset. Therefore, the address signal F(xa,ya) is incremented in synchronism with up-counting of the address of the display memory 11 by the counter 5.

In this manner, the hatched area in the memory 10 corresponding to that in the memory 4 shown in FIG. 1 is selectively transferred to the hatched area in the memory 11.

The operation timings for the partial transfer will be described with reference to FIGS. 2 to 5.

Figure 2:
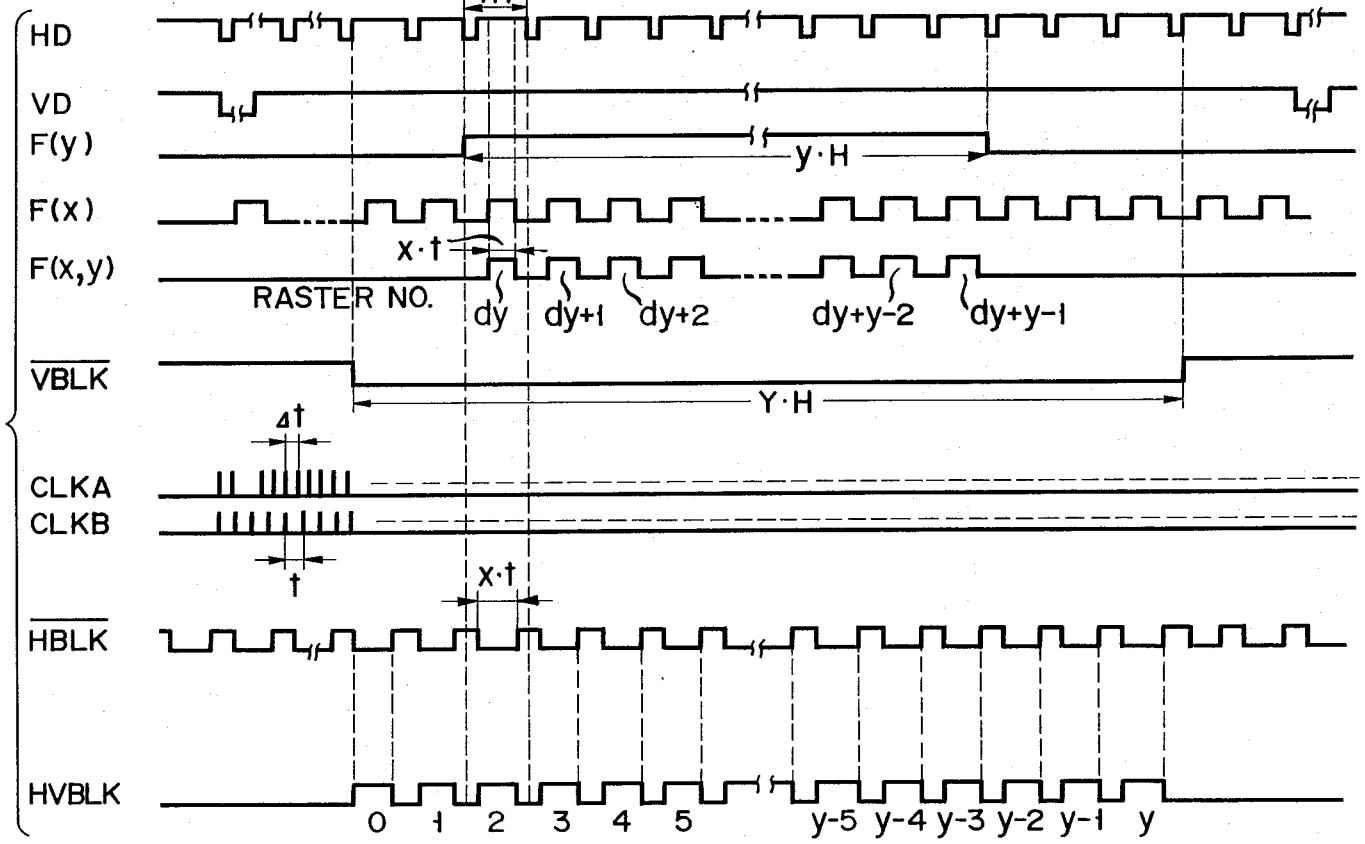
FIG. 2 is a waveform chart illustrating the timing of the x and y addresses of a partial transfer area in synchronism with the signals HD and VD according to the operation of the apparatus shown in FIG. 1.

Referring to FIG. 2, the signals F(x) and F(y) are generated in accordance with the mask pattern data f(x,y) indicating the partial transfer area set in the memory 4, and respectively indicate timings of the x and y addresses of the transfer area in synchronism with the signals HD and VD. The signal F(x,y) corresponds to the logical product of the signals F(x) and F(y), and is actually generated from the memory 4. The y·H period of the signal F(y) becomes a vertical partial transfer time (corresponding to the partial transfer address range). The output HVBLK of the AND gate 12 is the logical product of the signals $\overline{VBLK}$ and $\overline{HBLK}$ generated by the generator 3.

Figure 3:
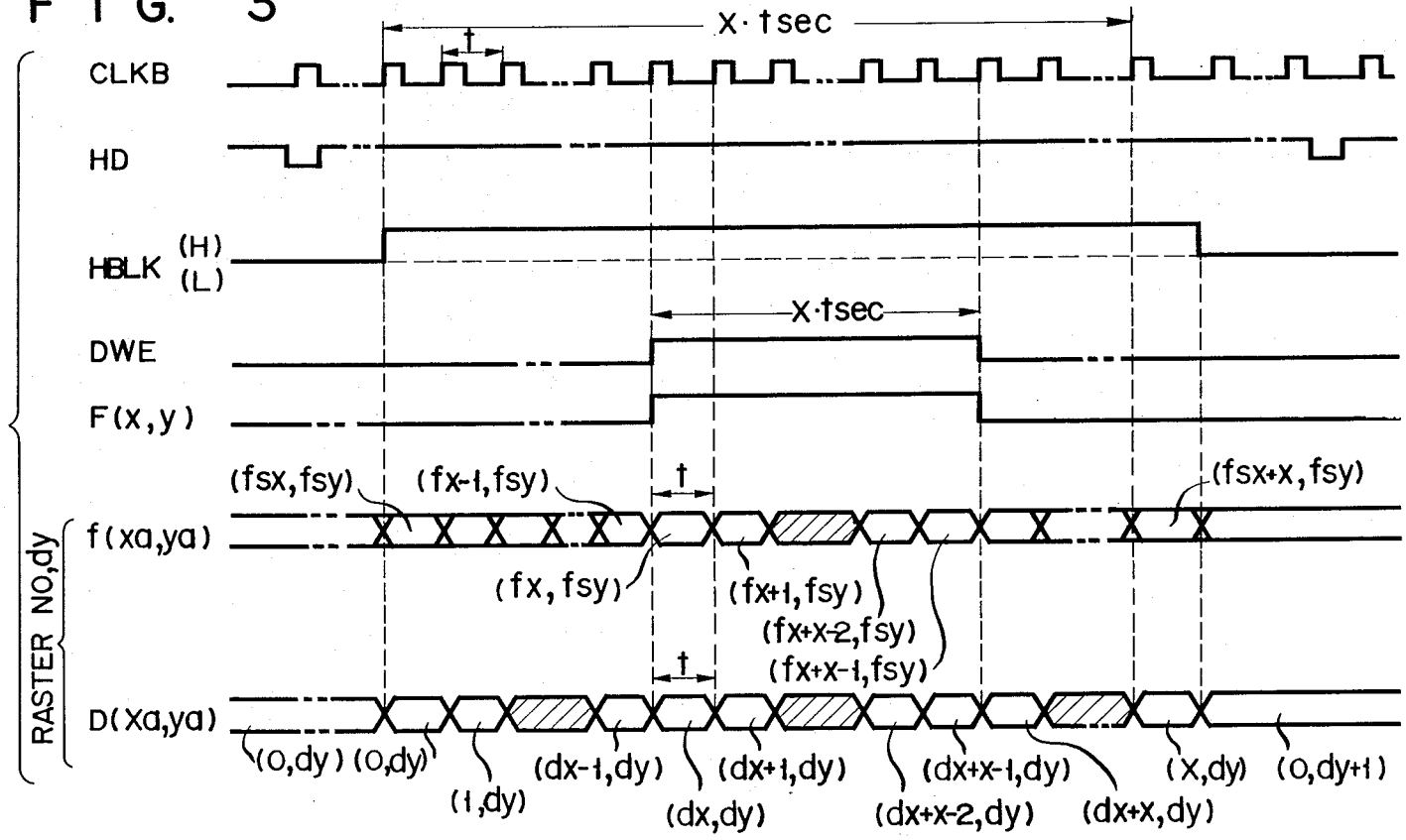
FIG. 3 is a waveform chart illustrating the timing of the read address f(xa,ya) for the incrementation of the raster no. dy according to the operation of the apparatus shown in FIG. 1.
Figure 4:
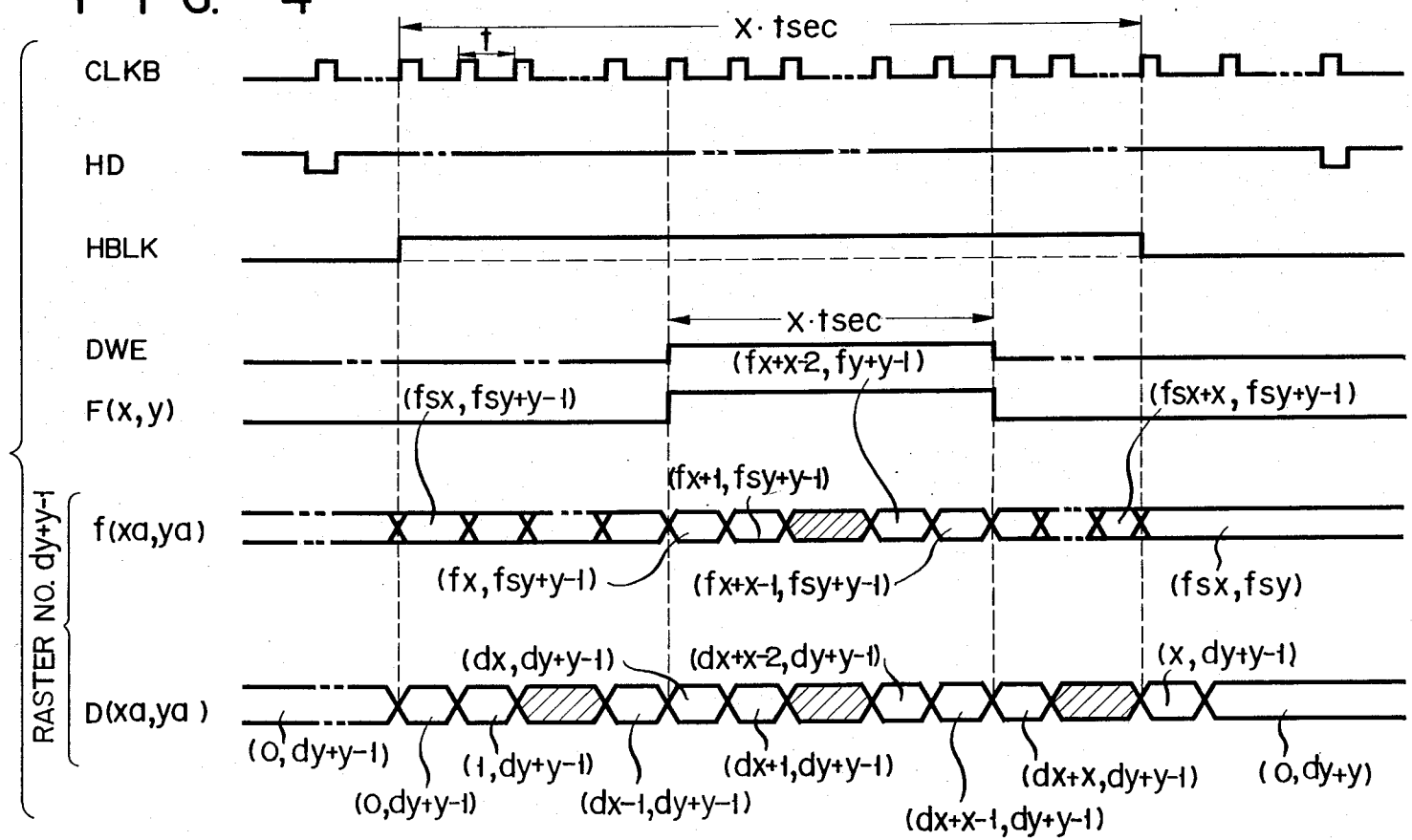
FIG. 4 is a waveform chart illustrating the timing of the read address f(xa, ya) for the incrementation of the raster no. $dy+y-1$ according to the operation of the apparatus shown in FIG. 1.

Furthermore, when the partial transfer matrix is given by $x \times y$, the address time corresponding to the horizontal address range of the transfer area is given by Xt sec, as shown in FIGS. 3 and 4. The read address f(xa,ya) of the memory 10 generated from the counter 2 during the Xt sec period is incremented in an order of (fx,fy), (fx+1,fy), . . . , (fx+x−2,fy), (fx+x−2,fy) up to (fx,fy+1). The read address f(xa,ya) is incremented by one address along the vertical direction, i.e., y direction, every time a line number, i.e., raster number dy, is updated. In this case, the address D(xa,ya) of the memory 11 is updated in an order of (0,dy), (1,dy), . . . , (dx−1,dy), (dx,dy), (dx+1,dy), . . . , (dx+x−1,dy), (dx+x,dy), . . . during the Xt sec period so as to correspond to horizontal scanning of the display unit 6. The address D(xa,ya) is used for displaying the transfer area of the matrix size $x \times y$ on the display unit 6.

Figure 5:
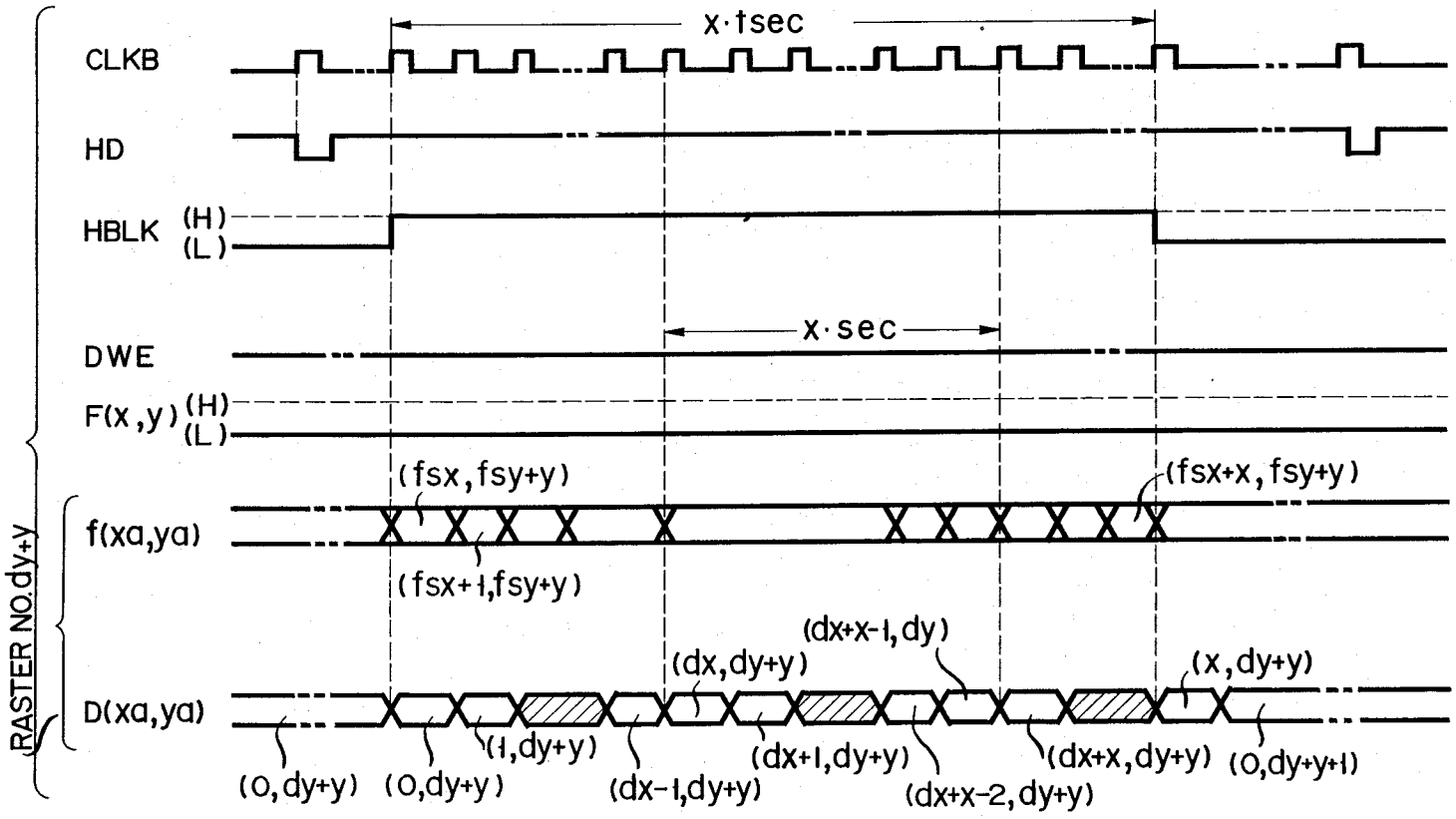
FIG. 5 is a waveform chart illustrating the timing of various signals excluding the vertical transfer area address period y·H according to the operation of the apparatus shown in FIG. 1.

It should be noted that FIG. 5 illustrates the timings of respective signals excluding the vertical transfer area address period y·H shown in FIG. 2. In this case, the signal F(x,y) goes to "L" (low level) because "0" is written in the area other than the transfer area.

When the signal F(x,y) falls within the area (i.e., partial transfer area) of F(x,y)="H", since the signal $\overline{DWE}$ is enabled, the image data at the address (fx,fy) on the memory 10 is written at the address (dx,dy) on the memory 11 through the memory 7. In other words, all the image data read out from the memory 10 is transferred to the memory 11 while the signal $\overline{DWE}$ is being enabled.

The output Dd from the memory 11 is supplied to the display unit 6 and is D/A converted, thus being displayed thereon.

Therefore, the desired area of the image data stored in the memory 10 is transferred to the memory 11 and the image data stored in the memory 11 is displayed by the display unit 6.

If images subjected to display are those of a plurality of frames which are sequentially changed, the above-mentioned transfer can be performed upon switching the images at high speed, thus performing cine display. Even when cine display is performed, the memory 11 need not have a large capacity. This is because when changing portions among images of a plurality of frames subjected to cine display are partially transferred, the images can be switched at high speed. Therefore, the memory 11 can store the image data for one frame or more, and all the image data corresponding to the images of the plurality of frames subjected to cine display need not be stored in the display memory.

When sequential images in motion of a plurality of frames for the same patient and body portion are stored in the memory 10, the read start address S(x,y) of the memory 10 is changed every time the image data for one frame is transferred, thus transferring the image data of the plurality of frames stored in the memory 10. When the images of the plurality of frames are sequentially switched, a stationary portion is first transferred to the memory 11, and a moving portion is set as the transfer area by the masking memory 4 so as to be partially transferred to the memory 11 (for example, a scano-image in an X-ray CT apparatus contains the image of a moving portion (e.g., a heart) and the image of the background (e.g., a bone). In this manner, a decrease in transfer time and frame memory capacity and an improvement in efficiency can be realized, and the images can be easily switched at high speed.

Furthermore, in partial transfer by the image display apparatus, in addition to the cine display and simple high-speed switching display, when the start address S(x,y), i.e. (fsx,fsy) of the frame memory 10, is arbitrarily changed and the image data having a desired matrix size $x \times y$ (where $X' \geqq X \geqq x$, $Y' \geqq Y \geqq y$) set in the masking memory 4 is transferred to the display memory 11, the desired portions of the image data can be transferred to different areas of the memory 11. Therefore, different types of images stored in the memory 10 can be transferred to different areas of the memory 11, and a plurality of different types of images can be displayed on the identical display screen.

In the above embodiment (corresponding to the timing charts in FIGS. 2 to 5), image data transfer from the memory 10 to the memory 11 is completed during a one-frame period (between two adjacent VD periods). However, even when every other scanning line is scanned in the interlaced scanning mode, a partial transfer can be performed.

Figure 6:
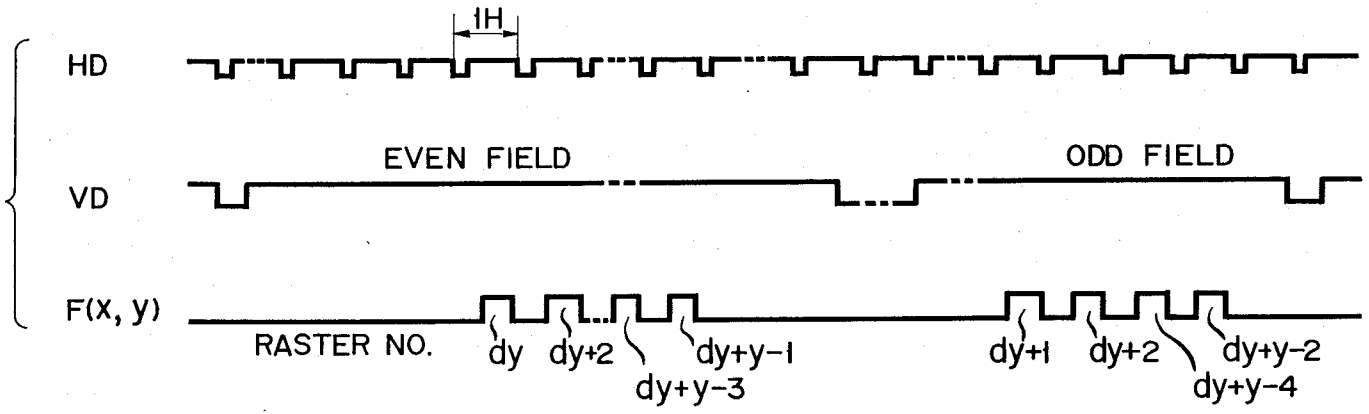
FIG. 6 is a waveform chart of respective signals for explaining an operation of an apparatus according to a second embodiment of the present invention.

As shown in the timing chart of FIG. 6, according to a second embodiment of the present invention, one-frame image data can be transferred by a set of odd-and even-field image data. Since interlaced scanning is performed, the vertical address increment operation of the counters 2 and 5 does not correspond to that of the first embodiment described above (the horizontal address increment operation of the second embodiment is the same as that of the first embodiment).

Figure 7:
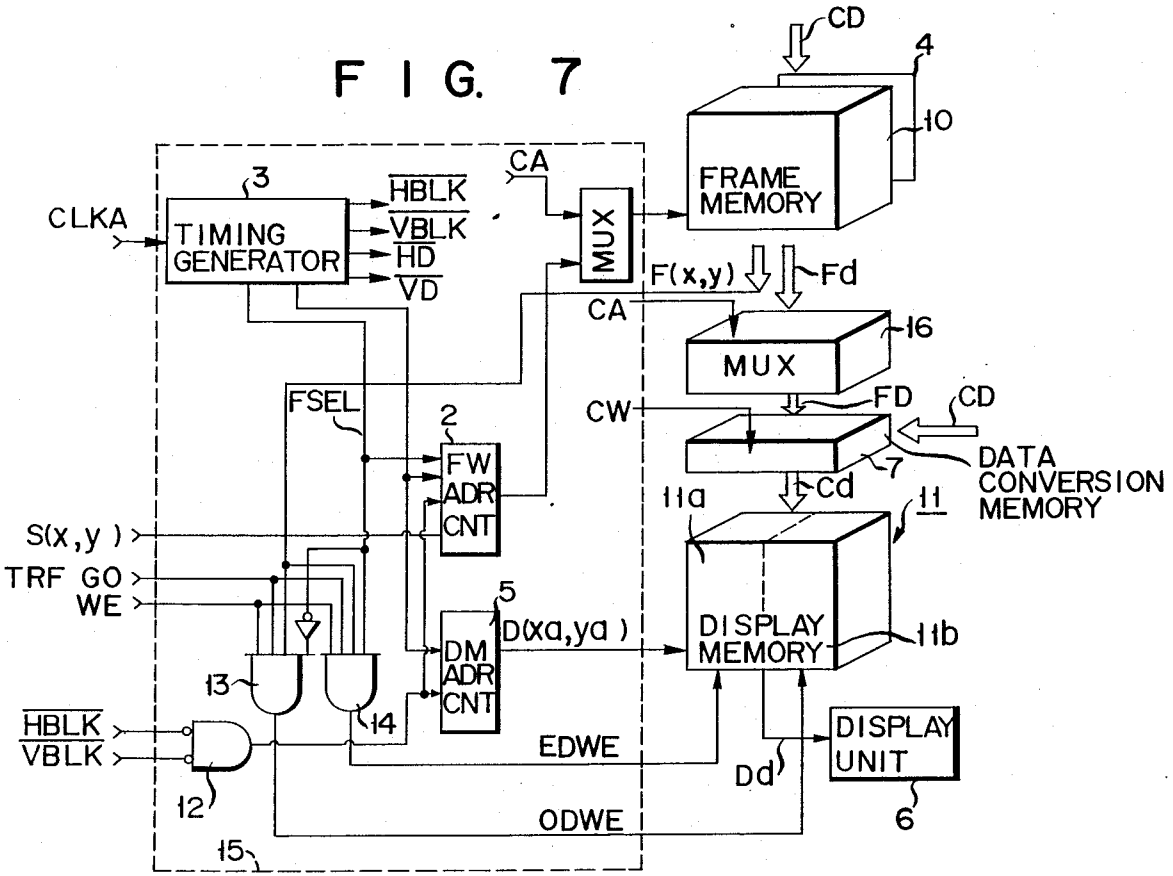
FIG. 7 is a block diagram showing a main part of an apparatus according to a third embodiment of the present invention.

Referring to the timing chart in FIG. 6, the odd- and even-field image data can be alternately transferred in units of pixels. In the even field period, only the even-field address data is transferred by the signal f(xa,ya). In the odd field period, only the odd-field address data is transferred by the signal f(xa,ya). FIG. 7 shows an apparatus according to the third embodiment adopting this transfer method.

As shown in FIG. 7, the logical products of an output FSEL from the generator 3 and the signals WE, TRFGO, and the mask pattern data F(x,y) read out from the memory 4 are generated from AND gates 13 and 14. The odd field is enabled by an output (ODWE) from the AND gate 13, and the even field is enabled by an output (EDWE) from the AND gate 14. An even-field memory portion (EMEM) and an odd-field memory portion (OMEM) of the memory 11 are switched in response to the outputs from the AND gates 13 and 14. In this case, the counter 2 is also switched for the odd and even addresses in response to the signal FSEL. With this arrangement, partial transfer in interlaced scanning can be performed. In this case, since the odd- and even-fields are alternately transferred to the display memory 11 in units of pixels, the access rate of the memory 11 can be decreased, and a low-speed memory can be used as the memory 11.

Figure 8:
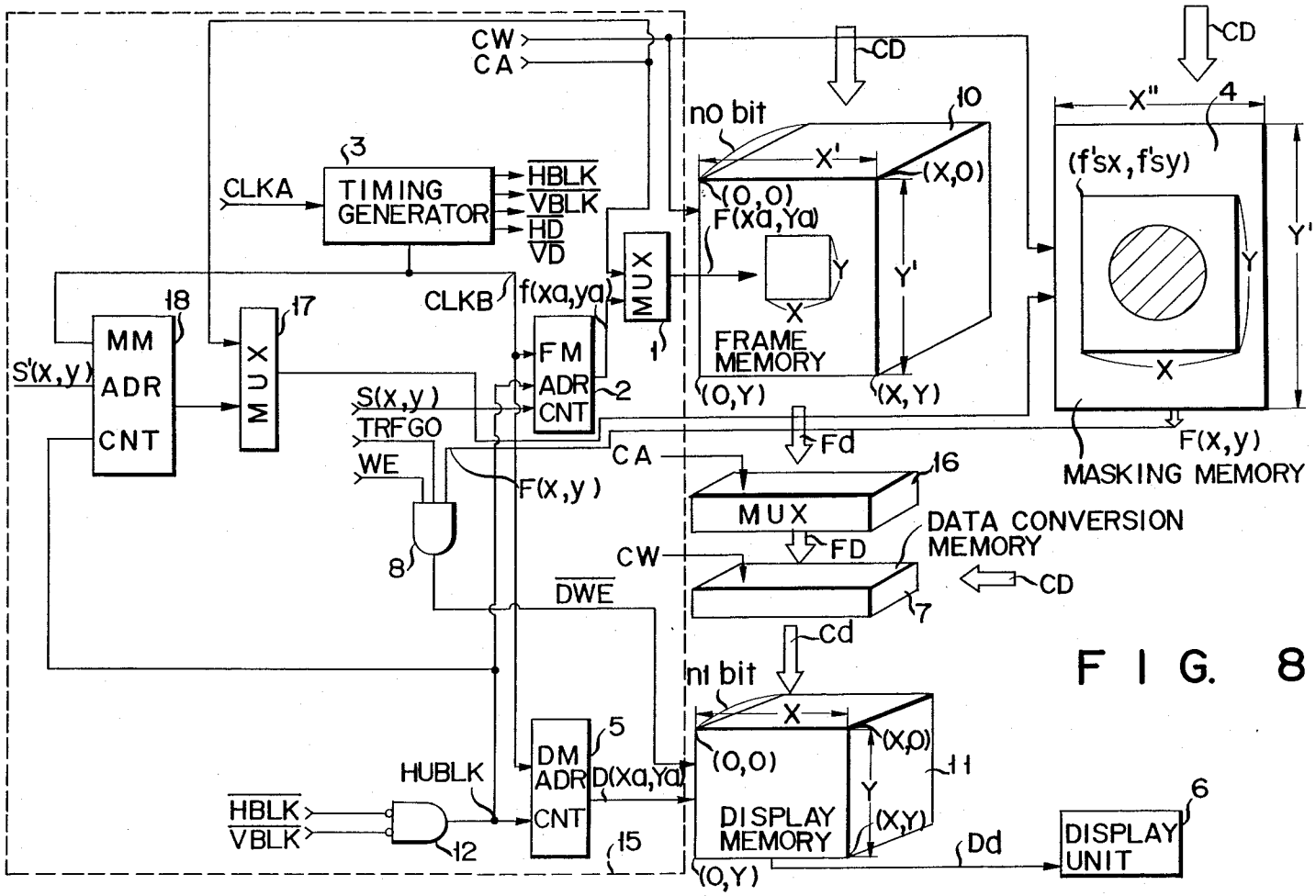
FIG. 8 is a block diagram showing a main part of an apparatus according to a fourth embodiment of the present invention.

FIG. 8 shows a fourth embodiment of the present invention. The same reference numerals in FIG. 8 denote the same parts as in FIG. 1.

In this embodiment, a matrix size $X'' \times Y''$ of the masking memory 4 is set to be sufficiently larger than a size $X' \times Y'$ of the frame memory 10. In the memory controller 15, a multiplexer 17 and a masking memory address counter (MM ADR CNT) 18 are additionally provided. A read start address (fsx',fsy') of the memory 4 is loaded in the counter 18 in response to a start address signal S'(x,y) supplied through the CPU. When the signal S'(x,y) is changed so as to change the address (fsx',fsy') of the memory 4, a partial transfer area (indicated by the circular hatched portion in FIG. 8) can be desirably moved on the memory 11.

What is claimed is:

1. A multiple memory image display apparatus comprising:

a frame memory for storing first image data;

data converting means for converting the first image data to second image data in a predetermined format for display as a visual image corresponding to the first image data and for generating the second image data in response to the first image data being read out from said frame memory and transferred to said data converting means;

a display memory, having a smaller memory capacity than said frame memory, for temporarily storing the second image data transferred from said data converting means;

displaying means for reading out the second image data from said display memory in synchronism with a predetermined synchronizing signal and for displaying the visual image corresponding to the converted first image data;

a masking memory, having a matrix structure corresponding to said frame memory, for storing masking pattern data corresponding to an image transfer area representing a part of the first image data which is to be transferred and displayed as a visual image;

address signal generating means, responsive to the readout operation of the second image data from said display memory, for generating a read address signal in synchronism with the synchronizing signal, said read address signal being altered responsive to every occurrence of said synchronizing signal, said read address signal being sent to both said frame memory and said masking memory, said read address signal for transferrring the part of the first image data stored in said frame memory set by said image transfer area; and control means for controlling and synchronizing the reading of the first image data from said frame memory into said display memory and the reading of the masking pattern data from said masking memory into said display memory with the writing of a portion of a second image data corresponding to the masking pattern data from said data converting means into said display memory wherein said second image data are switched at a high speed in a cine type display.

2. An apparatus according to claim 1, wherein said data converting means includes a data conversion table which is programmable.

3. An apparatus according to claim 1, wherein said data converting means includes a memory for storing the second image data at an address corresponding to the value of the first image data.

4. An apparatus according to claim 1, wherein the masking pattern data stored in said masking memory can be arbitrarily programmed by an external circuit.

5. An apparatus according to claim 1, wherein said address signal generating means can change a relative position of said image transfer area in said masking memory by an external circuit.

6. An apparatus according to claim 1, wherein said displaying means displays an image in response to a non-interlaced scanning method of scanning.

7. An apparatus according to claim 1, wherein said displaying means displays an image in response to an interlaced scanning method of scanning.

8. An apparatus according to claim 1, wherein said displaying means displays an image in response to an interlaced scanning method of scanning, and said display memory comprising an even-field memory portion and an odd-field memory portion.

9. An apparatus according to claim 1, wherein said displaying means displays an image in response to an interlaced scanning method of scanning said display memory comprises an even-field memory portion and an odd-field memory portion, and said address signal generating means generates an even-field address during an even-field display period and an odd-field address during an odd-field display.

* * * * *